US006796008B1

(12) United States Patent
Huang

(10) Patent No.: US 6,796,008 B1
(45) Date of Patent: Sep. 28, 2004

(54) REFLECTORIZED LACE AND THE LIKE

(75) Inventor: Ke-Chieh Huang, Chang Hua Hsien (TW)

(73) Assignee: Kae Sheng Webbing Co., Ltd., Changhua (TW)

( * ) Notice: Subject to any disclaimer, the term of this patent is extended or adjusted under 35 U.S.C. 154(b) by 0 days.

(21) Appl. No.: 10/361,182

(22) Filed: Feb. 10, 2003

(51) Int. Cl.[7] ..... A43C 1/00; A43C 9/00

(52) U.S. Cl. ..... 24/712; 24/712.1; 24/713; 24/714.3; 24/714.6; 24/715.1

(58) Field of Search ..... 24/712, 712.1, 24/713, 713.6, 714.3, 714.6, 715.3, 715.4, 715.1, 300

(56) References Cited

U.S. PATENT DOCUMENTS 2,887,005 A * 5/1959 Fromm ..... 87/1
3,035,476 A * 5/1962 Fogden ..... 87/9
3,110,945 A * 11/1963 Howe, Jr. ..... 24/713
4,252,871 A * 2/1981 Sundberg ..... 429/140
4,423,539 A * 1/1984 Ivanhoe ..... 24/715.3
5,023,982 A * 6/1991 Mehan ..... 24/715.3
5,832,574 A * 11/1998 Shin ..... 24/712.1
5,868,708 A * 2/1999 Hart et al. ..... 604/104
5,946,779 A * 9/1999 Chen ..... 24/712
6,260,246 B1 * 7/2001 Lampkins ..... 24/712.1
6,283,004 B1 * 9/2001 Tseng ..... 87/9
6,468,333 B2 * 10/2002 Spiegelman et al. ..... 96/135

* cited by examiner

*Primary Examiner*—Victor Sakran
(74) *Attorney, Agent, or Firm*—Harrison & Egbert

(57) ABSTRACT

A reflectorized lace or the like includes an inner layer, a reflectorized outer layer encasing the inner layer, and a protective layer covering the reflectorized outer layer. The protective layer is made of a woven material having a number of open spaces to allow passage of light rays. The protective layer is provided with one or more attachment patches by which the lace may be attached to an object.

2 Claims, 6 Drawing Sheets

REFLECTORIZED LACE AND THE LIKE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a lace or the like, and more particularly to a lace or the like which is furnished with reflectors.

BACKGROUND OF THE INVENTION

As shown in FIG. 5, a reflectorized lace 50 of the prior art comprises an outer layer which is provided with a coating of glass granules 51. The glass granules 51 serve as reflectors. The prior art reflectorized lace 50 can be easily broken or shattered due to the brittleness of the coating 51. In addition, the coating 51 is naked and can be easily stripped off by friction.

As shown in FIG. 6, the prior art reflectorized lace 50 is improved by adding to it a protective covering 52 which is transparent and is made of a plastic material. The luster condition of the protective covering 52 is bound to undermine the reflecting effect of the glass granules 51.

BRIEF SUMMARY OF THE INVENTION

The primary objective of the present invention is to provide a reflectorized lace which is free of the shortcomings of the prior art reflectorized laces described above.

In keeping with the principle of the present invention, the foregoing objective of the present invention is attained by a reflectorized lace or the like, which comprises an inner layer, an outer layer, and a protective layer. The inner layer is encased by the outer layer which is reflectorized. The outer layer is shielded by the protective layer of a loosely woven material. The protective layer is provided with a number of openings to allow passage of light rays.

The features and the advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
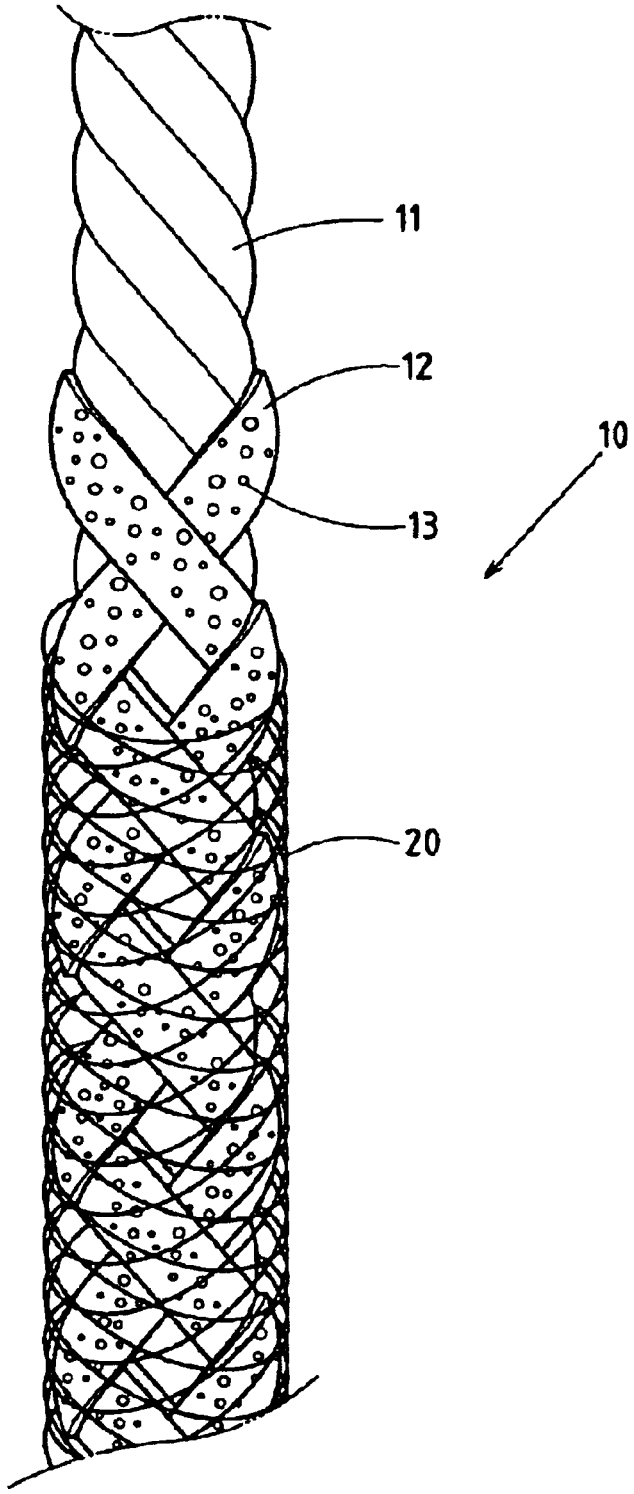
FIG. 1 shows a perspective view of a first preferred embodiment of the present invention.

As shown in FIG. 1, a lace 10 embodied in the present invention comprises an inner layer 11, an outer layer 12, and a protective covering 20.

The inner layer 11 is encased by the outer layer 12 which is provided in the outer surface with a large number of glass granules 13 serving as reflectors. In another words, the outer layer 12 is reflectorized.

The outer layer 12 is shielded by the protective covering 20 of a loosely woven material having a number of openings to allow the passage of light rays. The protective covering 20 is made of nylon threads, which are loosely woven.

Figure 2:
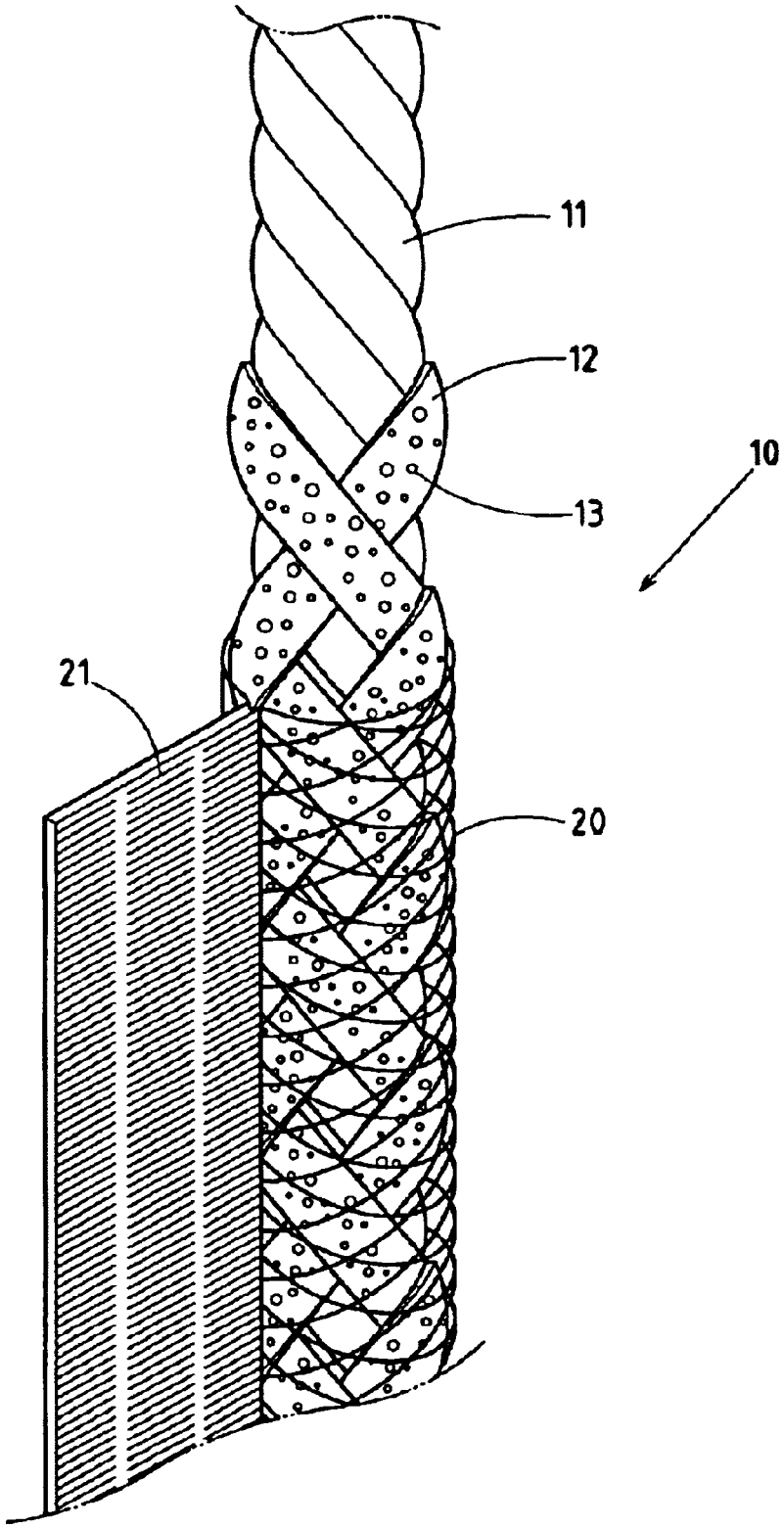
FIG. 2 shows a perspective view of a second preferred embodiment of the present invention.
Figure 3:
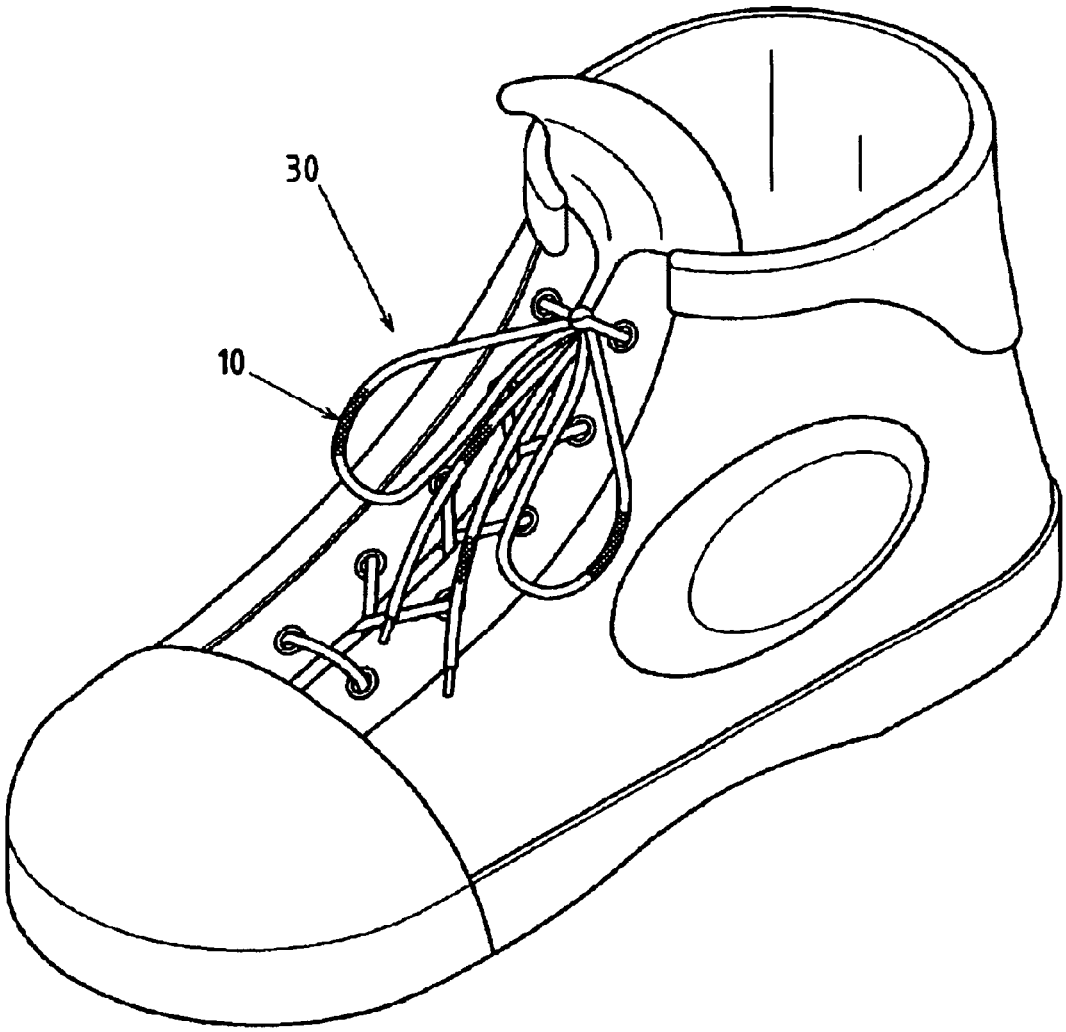
FIG. 3 shows a schematic view of application of the present invention to the shoelace.
Figure 4:
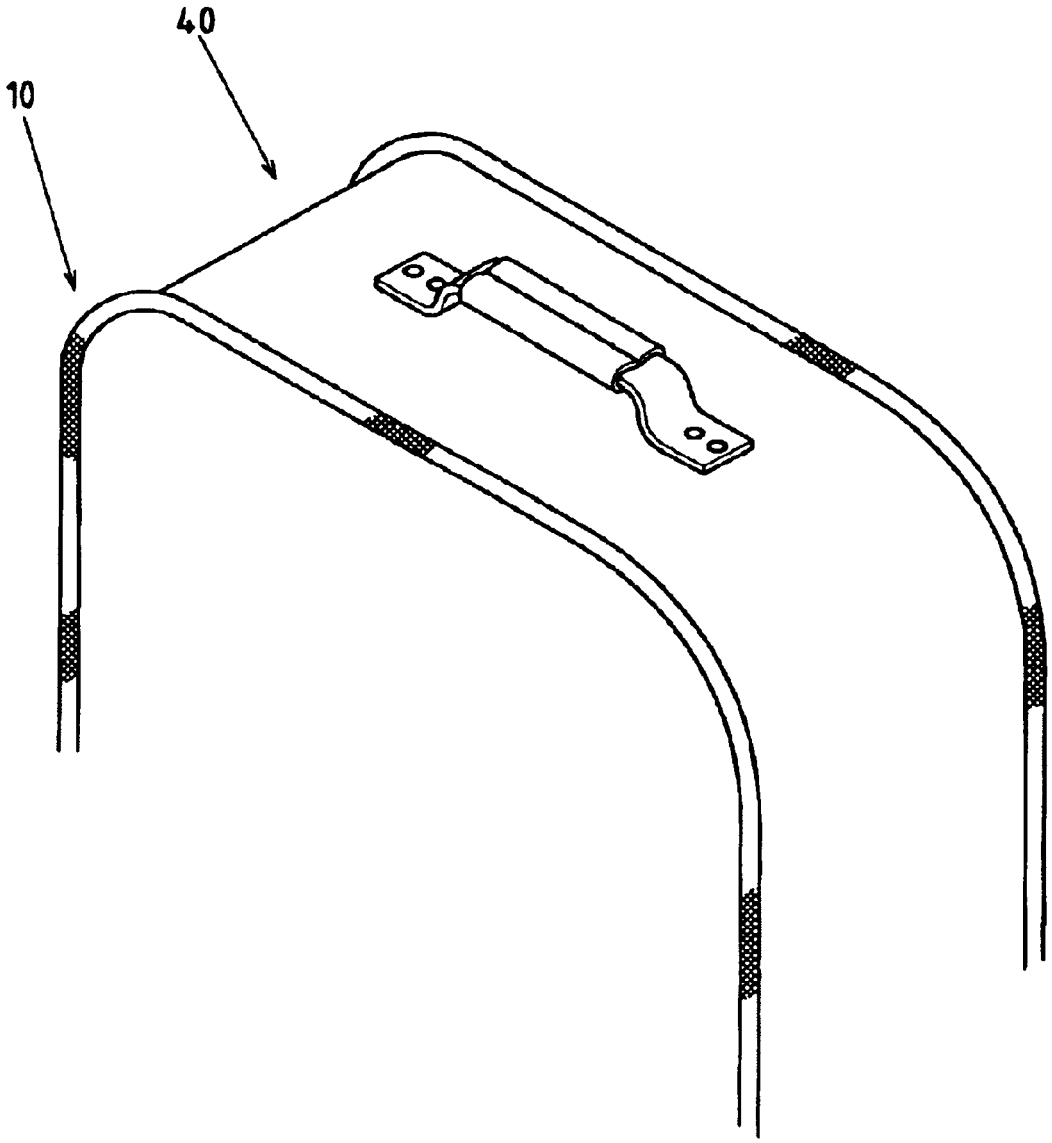
FIG. 4 shows a schematic view of application of the present invention to the luggage shell.
Figure 5:
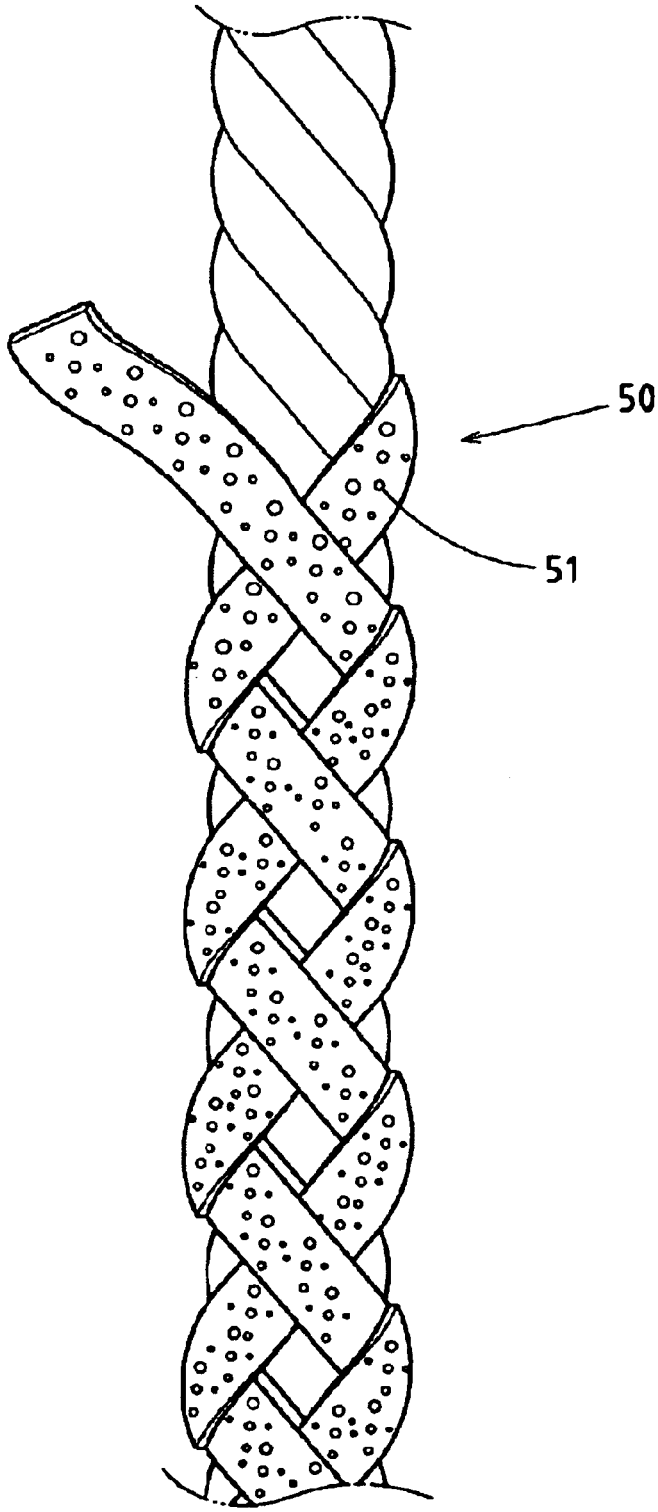
FIG.5 PRIOR ART
FIG. 5 shows a perspective view of a reflectorized lace of the prior art.
Figure 6:
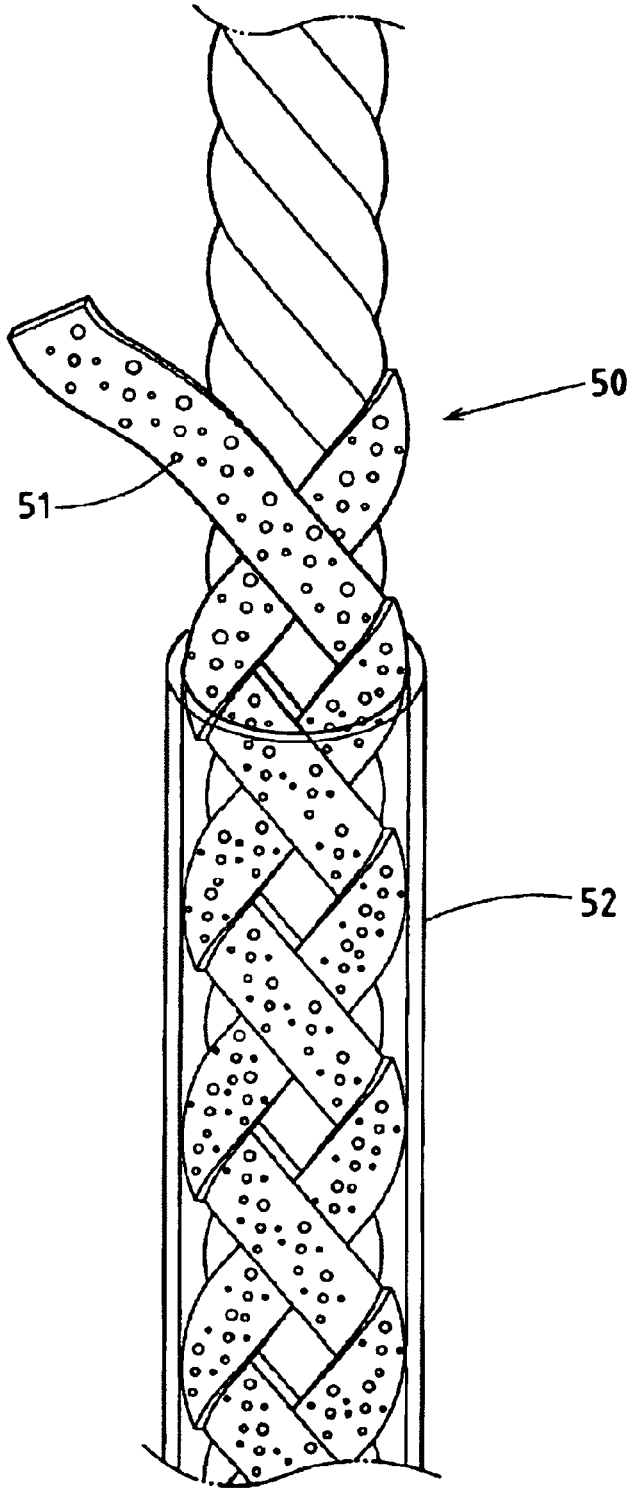
FIG.6 PRIOR ART
FIG. 6 shows a perspective view of another prior art reflectorized lace.

As shown in FIG. 2, the protective covering 20 of the lace of the present invention is provided with an attachment patch 21 fastened therewith. The lace 10 of the present invention may be attached to an object by the attachment patch 21 which is fastened to the object by sewing or adhesive. For example, the lace 10 of the present invention is attached to a shoelace 30, as shown in FIG. 3, or luggage shell 40, as shown in FIG. 4.

In light of the protective covering 20 of the present invention being of a mesh-like structure, the protective covering 20 shields effectively the reflectorized outer layer 12 without undermining the reflecting effect of the reflectorized outer layer 12.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A reflectorized lace assembly comprising:

an inner layer having a length dimension and an outer diameter;

an outer layer having a woven pattern extending over said inner layer for at least a portion of said length dimension and around said outer diameter of said inner layer, said outer layer having a plurality of light-reflecting glass granules embedded therein, said plurality of light-reflecting glass granules having a portion extending outwardly of an outer surface of said outer layer; and a protective layer extending over and around said outer layer, said protective layer having a thickness that is greater than a distance that said plurality of light-reflective glass granules extend outwardly of said outer layer, said protective layer being a mat of woven nylon fibers, the fibers being separated from each other by a distance suitable for allowing a passage of light rays therebetween to said plurality of light-reflective glass granules.

2. The assembly of claim 1, said protective layer having at least one attachment patch attached thereto, said attachment patch suitable for attaching said protective layer to an object.

* * * * *